US006227644B1

(12) United States Patent
Perner

(10) Patent No.: US 6,227,644 B1
(45) Date of Patent: May 8, 2001

(54) INKJET DOT IMAGING SENSOR FOR THE CALIBRATION OF INKJET PRINT HEADS

(75) Inventor: Frederick A. Perner, Palo Alto, CA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/072,408

(22) Filed: May 4, 1998

(51) Int. Cl.[7] ..... B41J 29/393
(52) U.S. Cl. ..... 347/19
(58) Field of Search ..... 347/19, 12, 44, 347/40, 14, 3; 358/302; 346/75; 355/326

(56) References Cited

U.S. PATENT DOCUMENTS

| | | | | |
|---|---|---|---|---|
| 4,339,208 | | 7/1982 | Biedermann . | |
| 4,493,993 | * | 1/1985 | Kanamuller et al. | 347/19 |
| 4,540,990 | * | 9/1985 | Crean | 347/19 |
| 4,639,747 | * | 1/1987 | Sakurada et al. | 347/12 |
| 4,907,013 | * | 3/1990 | Hubbard et al. | 347/19 |
| 4,977,459 | * | 12/1990 | Ebinuma et al. | 347/19 |

FOREIGN PATENT DOCUMENTS

| | | | | |
|---|---|---|---|---|
| 0 461 759 | | 12/1991 | (EP) . | |
| 0 540 244 | | 5/1993 | (EP) . | |
| 63-260448 | * | 10/1988 | (JP) | 347/19 |
| 3 146 383 | * | 6/1991 | (JP) | 347/19 |

OTHER PUBLICATIONS

R.L. Linton, "Dot Location Measurement System"–IBM Technical Disclosure Bulletin, vol. 26, No. 3A–Aug. 1, 1983 XP002 136443.

* cited by examiner

*Primary Examiner*—John Barlow
*Assistant Examiner*—Charles W. Stewart, Jr.

(57) ABSTRACT

A print head for use in inkjet printers and the like. The print head includes a plurality of nozzles for delivering droplets of ink onto a print medium and thereby producing dots on the print medium. The print head also includes an imaging sensor for forming an image of the dots in response to a control signal. A controller in the print head reads out the image information to a processor connected to the print head. In one embodiment of the invention, the image is formed and readout in response to the detection of a dot from one of the nozzles by a sensor. In the preferred embodiment of the present invention, the nozzles are arranged in a regular array characterized by inter-nozzle spacing and the imaging sensor includes a rectangular two-dimensional array of photodetectors in which the photodetectors are spaced apart from one another by a distance less than the inter-nozzle spacing. Embodiments utilizing bit serial processors for processing the output of the detectors in each row of the two-dimensional array are also described.

7 Claims, 2 Drawing Sheets

INKJET DOT IMAGING SENSOR FOR THE CALIBRATION OF INKJET PRINT HEADS

FIELD OF THE INVENTION

The present invention relates to computer printers, and more particularly, to print heads utilized in inkjet printers and the like.

BACKGROUND OF THE INVENTION

Computer printers based on a printing mechanism that expels droplets of ink toward the paper are often referred to as "inkjet" printers. These printers cost substantially less than laser based printers while providing equivalent resolutions and the ability to print in color. However, the cost of the ink cartridges raises the per page cost of black and white printing to above that obtainable with laser based printers.

Inkjet printers utilize a print head that has a number of nozzles through which the ink is propelled. In one type of printer head, the ink droplets are propelled by heating the ink in a capillary tube such that the expansion of the heated ink forces the ink nearest the end of the capillary tube to be expelled. Each nozzle has one such capillary tube and the related circuitry to drive the heating element. The circuitry is typically contained on a "chip" that is part of the print head. The cartridge is normally thrown out when the ink supply in one of the reservoirs is exhausted; however, kits for refilling the ink reservoirs are available. Unfortunately, the print heads have a finite lifetime determined by wear and clogging of the nozzles. Hence, relatively few refillings may be utilized before the quality of the printing becomes unacceptable.

InkJet print heads do not always shoot straight to the predicted print locations. The location at which the drop lands and the shape of the drop are partially determined by the driving voltages used to expel the droplet. The speed with which the droplet is expelled can be controlled by the power applied to the heater that expands the liquid behind the droplet. Since the print head is also moving during the printing process, the droplet lands at a location that depends on the speed of the droplet and the print head speed. In addition, the shape of the spot on the paper is also partially determined by the speed with which the droplet is expelled. If the droplet is expelled at too high a velocity, the droplet will breakup in flight or splatter when it hits the page.

After manufacture, the print heads are tested to eliminate those that shoot with less than the required precision. In addition, normal wear on the print head changes the shape and the trajectory of the ink drops so that ragged lines with uncontrolled spaces may appear affecting the quality of the display. The need to throw out print heads that do not shoot within limits after manufacture lowers the yield of the production line, and hence, increases the cost of the print heads. The wear-related failures shorten the life of the print heads, and hence, also increase the cost of printing with inkjet printers.

If the results of each nozzle could be sensed during a calibration sequence, many of the problems that cause the head to shoot poorly could be corrected by adjusting the power delivered to the nozzle and the nozzle firing timing to compensate for the problems. For example, a nozzle that is delivering a droplet that is splattering could be corrected by reducing the power used to expel the droplets, and thereby, reduce the impact speed of the droplet on the paper. Similarly, the position of the dot on the paper along the direction of motion of the print head can be altered by adjusting the timing of the nozzle firing.

In addition, periodic calibration would enable corrections to be made over the life of the cartridge thereby increasing the usefull lifetime of the cartridge. As noted above, even when refilled, inkjet print heads have a relatively short lifetime because of wear. Some of the wear related problems can be corrected by adjusting the driving parameters of the individual nozzles. Hence, providing a calibration system on the printer can also extend the useful lifetime of the print head.

Broadly, it is the object of the present invention to provide an improved inkjet print head.

It is a further object of the present invention to provide an inkjet print head that can sense the location at which various nozzles deliver ink drops.

It is a still further object of the present invention to provide an inkjet print head that can sense the shape of the dots generated by each of the nozzles.

These and other objects of the present invention will become apparent to those skilled in the art from the following detailed description of the invention and the accompanying drawings.

SUMMARY OF THE INVENTION

The present invention is a print head for use in inkjet printers and the like. The print head includes a plurality of nozzles for delivering droplets of ink onto a print medium and thereby producing dots on the print medium. The print head also includes an imaging sensor for forming an image of the dots in response to a control signal. A controller in the print head reads out the image information to a processor connected to the print head. In one embodiment of the invention, the image is formed and readout in response to the detection of a dot from one of the nozzles by a sensor. In the preferred embodiment of the present invention, the nozzles are arranged in a regular array characterized by inter-nozzle spacing and the imaging sensor includes a regular two-dimensional array of photodetectors in which the photodetectors are spaced apart from one another by a distance less than the inter-nozzle spacing. The preferred two-dimensional array of photodetectors is a plurality of rows of photodetectors that are coupled to a plurality of analog-to-digital converters (A/Ds), each A/D corresponding to one of the rows. Each A/D generates a digital value indicative of a selected photodetector in the row corresponding to that A/D, the selected photodetector being specified by the pointer. In one embodiment of the invention, a plurality of processors further processes the output of the A/Ds, one such processor corresponding to each of the rows. Each processor performs computations based on the A/D outputs for the row corresponding to that processor to generate an output value for that row. The output value provides information on the location and size of the dot scanned by that row of photodetectors. The output values are stored in a register whose contents are readout by the controller.

DETAILED DESCRIPTION OF THE INVENTION

The present invention is a print head with a built-in imaging system that allows the position and shape of the drops produced by the nozzles be measured. In the preferred embodiment of the present invention, the position of each dot is measured relative to a reference dot during a calibration operation. The information is encoded for use by a printer driver to correct the trajectories of the dots. Since the print head already includes an integrated circuit chip, the present invention is preferably incorporated into that chip. Hence, the present invention does not markedly increase the cost of the print head or the printer.

Figure 1:
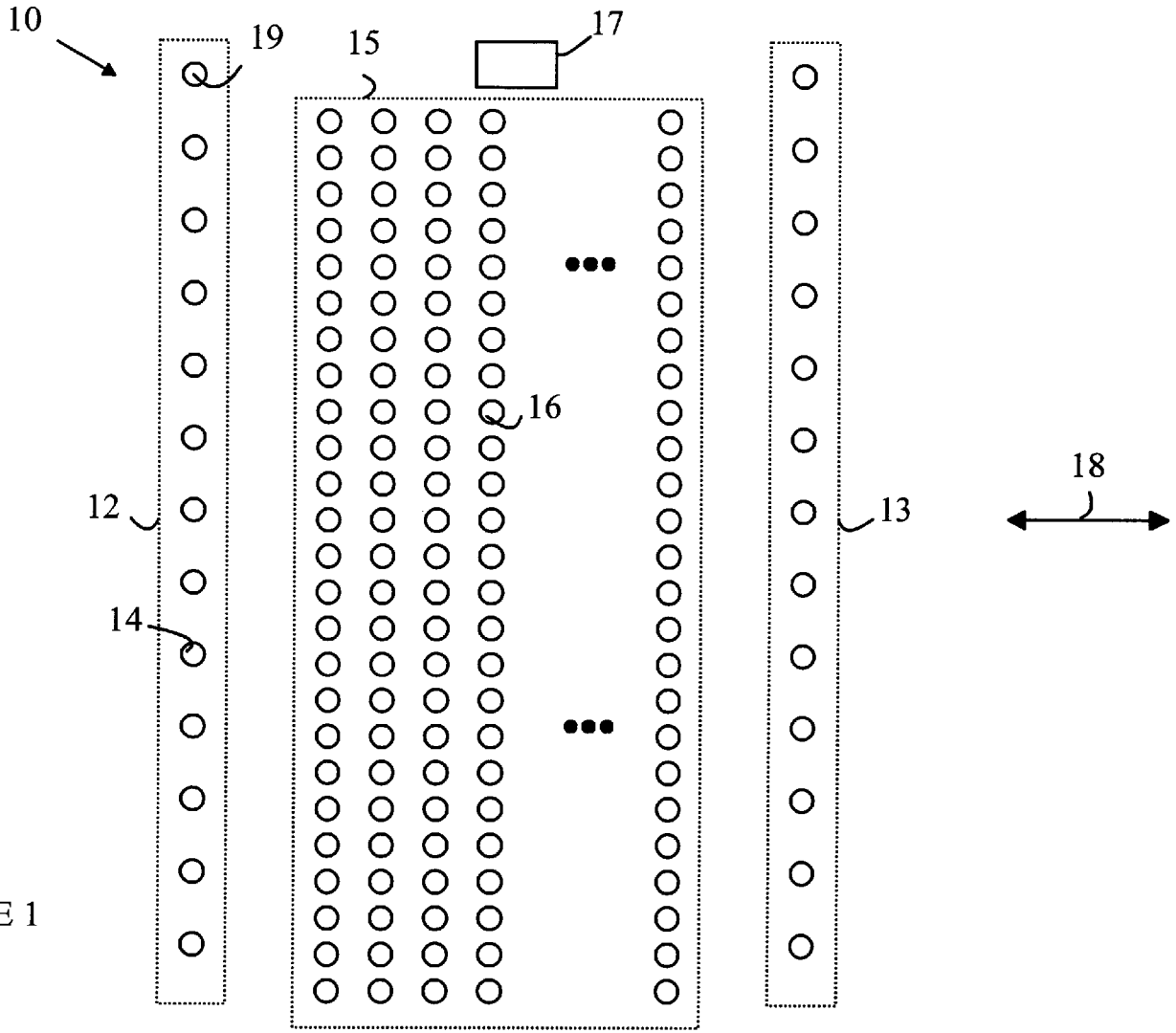
FIG. 1 is a bottom view of a portion of a print head according to the present invention.

The manner in which the present invention operates may be more easily understood with reference to FIG. 1, which is a bottom view of a print head 10 according to the present invention. Print head 10 includes two rows of nozzles shown at 12 and 13. An exemplary nozzle is shown at 14. Each row of nozzles is used for a different color ink. For simplicity, only two of the rows normally found in a print head are shown; however, it is to be understood that additional rows of nozzles are typically present. Color print heads typically have three or four rows of nozzles.

An imaging array 15 is located between two of the rows of nozzles. The array is preferably a two dimensional array having a pixel density that is greater than that of the nozzles so that the position and shape of the spots generated by the nozzles can be determined to a precision greater than the inter-nozzle spacing. In the preferred embodiment of the present invention, there are two imaging detectors for each nozzle. A typical photodetector is shown at 16. The print head moves bi-directionally in the direction shown at 18.

The output of each row of nozzles is measured separately. The direction of travel of the print head over the paper is selected such that imaging array 15 passes over the spots generated by the current row of nozzles. In the preferred embodiment of the present invention, image array 15 is triggered by the detection of a spot generated by nozzle 19 by sensor 17. This assures that the image generated by the row of nozzles currently being measured in the center of imaging array 15.

The present invention preferably utilizes an electronic shutter for the imaging operation. The preferred imaging array is a CMOS active pixel photo diode array. The detectors in the array integrate the light received by each detector since the array was last reset. Hence, the data must be read out of the array quickly if a separate shutter to control the light entering the array is not provided. In the preferred embodiment of the present invention, the array consists of 600×64 photodetectors for measuring the output of 300 nozzles. The data in this array must be readout in 10 milli-seconds or less.

The printer is typically connected to the computer by a relatively slow communication link; hence, the data from the imaging array cannot be read directly to the computer attached to the printer. Accordingly, the data must be processed on the chip and then sent to the computer for use by the calibration system. At a minimum, the data must be converted from analog to digital form and stored.

Figure 2:
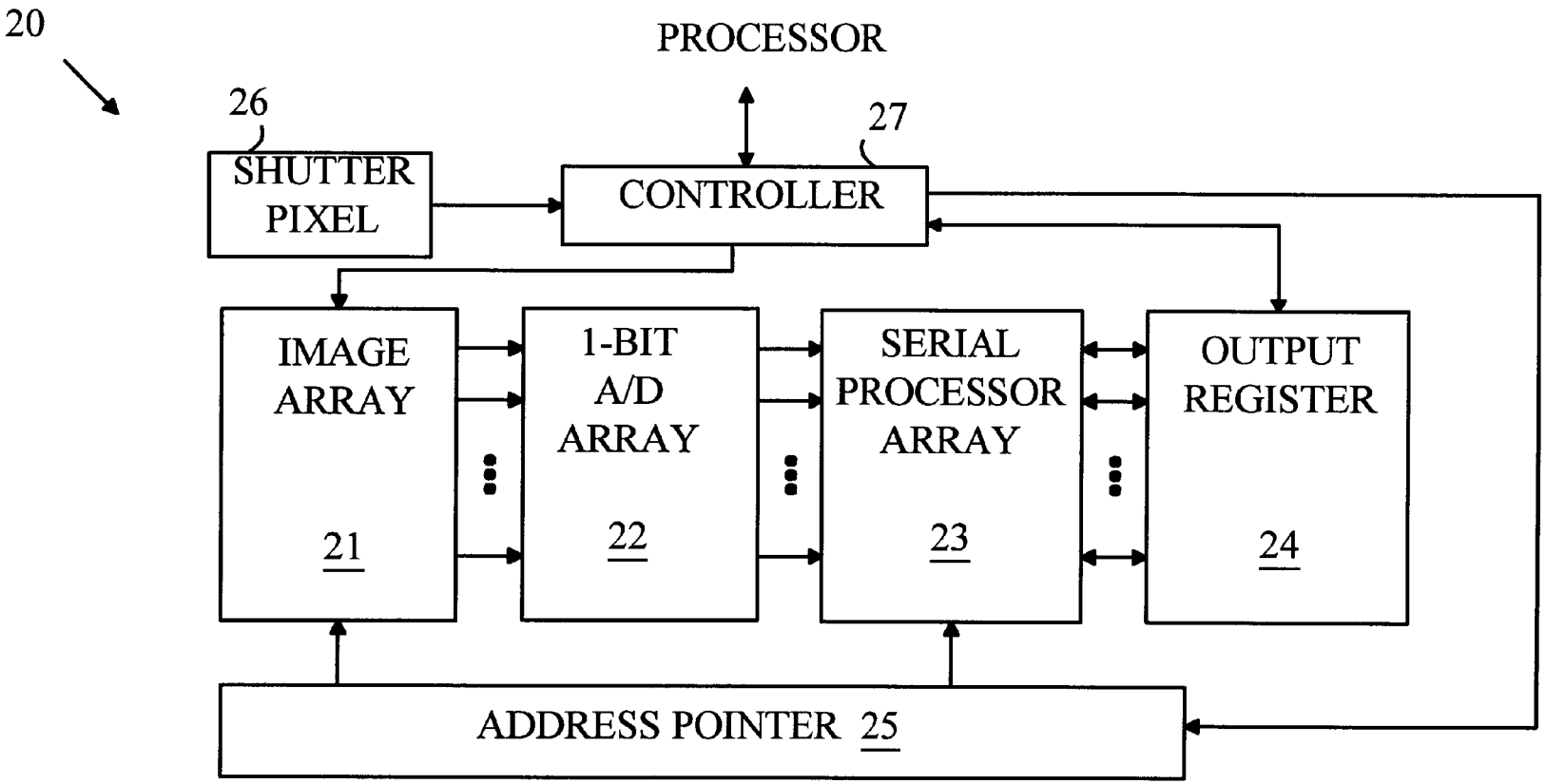
FIG. 2 is a block diagram of an imaging system according to the present invention.

In the preferred embodiment of the present invention, the data is also processed to further reduce the amount of data that must be sent to the computer. To provide the required processing speed, a separate one-bit A/D converter and a separate bit serial processor is provided for each of the 600 rows of image sensors in the array. Refer now to FIG. 2, which is a block diagram of an imaging system according to the present invention. Imaging system 20 includes an imaging array 21 such as described above with reference to FIG. 1. When shutter pixel 26 detects the reference dot, the image array is reset. After the imaging array has received sufficiently exposure, controller 27 initiates the readout of imaging array 21. The exposure time is short compared to the time needed for the print head to move the distance of one ink dot; hence, the imaging array "freezes" the motion.

The data from each row is shifted into a corresponding processor in processor array 23 after being converted from analog to digital by the corresponding one-bit A/D converter in A/D converter array 22. The output of each bit serial processor in processor array 23 is stored in a corresponding 9-bit word in output register 24. The contents of this register are then read-out to the computer connected to the printer. The specific bit in imaging array 21 that is being processed at any given time is specified by address pointer 25 which connects that bit to the corresponding A/D converter and provides the address to the bit-serial processors. After all of the detectors in image array 21 have been processed, the output of register 24 is sent to the processor under the control of controller 27. The process is then repeated until all of the nozzles have been examined and the calibration procedure completed. Since the communication of data from a register to the processor is conventional in the art, it will not be discussed further here.

In the preferred embodiment of the present invention, the bit serial processors determine three parameters for each row of pixels. The first parameter is the location of the centroid of the ink drop, referred to as AddrC. Six of the 9 bits in the output register are utilized for this parameter. The second parameter is the size of the drop referred to as Wt. Two of the 9-bits in the output register are used for this parameter. The third parameter is an error flag, referred to as BigDot, which occupies one bit of the output registers. The error flag is set to indicate a dot that is bigger than 3 pixels wide. These parameters and the internal parameters, Space, Pass, and Mdot, are reset to zero at the beginning of the readout operation.

On each clock cycle, the pixel at the current pointer location, AddrN, is converted by the one bit A/D converter to a binary value, DotN. This operation is triggered by the rising edge of a clock that is part of controller 27. The falling edge of the clock signal triggers the bit serial process to perform the following algorithm:

1. If DotN=0 and Wt=0 and Pass=0
   No Action
   The line is blank up to this value of AddrN
2. If DotN=0 and Pass=1
   No Action
   The line is blank after 1 or more dark pixels.
3. If DotN=0 and (Wt=1 or Wt=2 or Wt=3) and Space=1 and Pass=0
   Pass=1
   The calculation of the Centroid is complete. Note more than one space is used to indicate the end of an ink drop
4. If DotN=0 and (Wt=2 or Wt=3) and Space=0 and Pass=0
   Space=1
   Set the space variable to '1' as a first step in detecting the end of an ink drop. In this algorithm, a single space (DotN=0) between two dark dots (DotN=1) is allowed as part of a valid ink dot
5. If DotN=1 and Wt=3 and Pass=0
   BigDot=1
   Pass=1
   If the size of the ink dot is greater than 3 pixels, then the ink dot is assumed to be too large. An output flag (BigDot=1) is used to indicate this condition.

This variable may be used to adjust the reference level of the comparator in the 1-bit A/D converter for a second pass at reading the array.

6. If DotN=1 and Wt=0 and Pass=0
   Wt=1
   AddrC=AddrN
   This is the first pixel indicating the presence of an ink dot. Wt is set to '1' and the Centroid is the current AddrN
7. If DotN=1 and Wt=1 and Space=0 and Pass=0
   Wt=2
   AddrC=AddrN
   This is a second dark pixel adjacent to the first. Wt is incremented and the Centroid is changed to the current value of AddrN
8. If Dot=1 and Wt=2 and Space=0 and Pass=0
   Wt=3
   This is a third dark pixel adjacent to the second. Wt is incremented and the Centroid does not change.
9. If DotN=0 and Wt=1 and Space=0 and Pass=0
   Space=1
   Mdot=1
   A space indicates either one valid space between dark pixels or the end of the ink dot. The value of the centroid does not change, the variable Space is set to '1', and a temporary variable (Mdot) is set to '1'
10. If DotN=1 and Space=1 and Wt=1 and Mdot=1 and Pass=0
    AddrC=AddrN
    Mdot=0
    Wt=2
    This is a dark pixel after a single space, the Centroid address is changed to AddrN, temporary variable Mdot is reset to '0', and dot weight variable is incremented.
11. If DotN=1 and Space=1 and Wt-2 and Mdot=1 and Pass=0
    Wt=3
    This is a dark pixel after a single space, the Centroid address is equal to AddrC defined in Step #7 above and the temporary variable Mdot is reset to '0' and the dot weight variable is incremented.
12. If DotN=1 and Space=1 and Wt=2 and Mdot=0 and Pass=0
    Wt=3
    Mdot=0
    This is a dark pixel following a dark pixel preceded by a space, the Centroid address is equal to AddrC defined in Step #10 above and the temporary variable Mdot is reset to '0' and the dot weight variable is incremented.
13. If Dotn=1 and Pass=1
    BigDot=1
    Error conditions—2 or more spaces between dark pixels.

While the preferred embodiment of the present invention provides the on-chip processing described above, it will be obvious to those skilled in the art from the preceding discussion that embodiments of the present invention that do not provide such processing may also be constructed. In one such embodiment, processor array 23 shown in FIG. 2 is eliminated and output register 24 is expanded to a width of 64 bits.

The present invention assumes that sufficient ambient light is available to image the dots produced on the paper into the image sensor. Hence, no light source is supplied on the chip. Since the present invention is intended for use during calibration, lights can be supplied at one location on the print carriage if the ambient light is not sufficient. However, it will be obvious to those skilled in the art from the preceding discussion that the sensor may include one or more LEDs for illuminating the area viewed by the imaging array. A light pipe may be used to channel light from discrete LEDs mounted near the print head to illuminate the imaging area under the print head. In this case, the LEDs can be pulsed to provide a light pulse, which acts as an electronic shutter. If such a shutter arrangement is utilized, the image can be stored on the imaging array for a period of time sufficient to readout the image array through the A/D converters directly to the processor. That is, output register 24 can also be eliminated.

The above-described embodiments of the present invention utilized a sensor 17 for triggering the imaging array. However, it will be obvious to those skilled in the art from the proceeding discussion that the array could also be triggered at a predetermined time after the nozzles are fired. The use of sensor 17 is preferred, as the triggering is independent of the particular array of nozzles being calibrated.

Various modifications to the present invention will become apparent to those skilled in the art from the foregoing description and accompanying drawings. Accordingly, the present invention is to be limited solely by the scope of the following claims.

What is claimed is:

1. A print head comprising:

a plurality of nozzles for delivering droplets of ink onto a print medium thereby producing dots on said print medium, said nozzles being spaced apart from one another;

an imaging sensor for forming an image of said dots in response to a control signal, said imaging sensor comprises a regular two-dimensional array of photodetectors having a plurality of rows of photodetectors; and a controller for processing said image and reading out information derived from said image, said controller comprising a plurality of analog-to-digital converters (A/D), each A/D corresponding to one of said rows, each A/D generating a digital value indicative of a selected photodetector in said row corresponding to said A/D, said selected photodetector being specified by a pointer.

2. The print head of claim 1 further comprising a pixel sensor, said pixel sensor comprising a photodetector for detecting a dot generated by a predetermined one of said nozzles and a circuit for generating said control signal in response to said photodetector detecting that dot.

3. The print head of claim 1 further comprising a plurality of processors for processing the output of said A/Ds, one such processor corresponding to each of said A/Ds, each processor performing computations based on the digital values generated by said A/D to generate an output value corresponding to said row corresponding to that A/D.

4. The print head of claim 3 wherein said output value indicates the location of the image of a portion of a dot that was imaged by said photodetectors in said row corresponding to said processor.

5. The print head of claim 3 wherein said output value indicates the size of the image of a portion of a dot that was imaged by said photodetectors in said row corresponding to said processor.

6. The print head of claim 3 further comprising an output register, said output register storing said output values generated by said processors.

7. A print head comprising:

a plurality of nozzles for delivering droplets of ink onto a print medium thereby producing dots on said print medium, said nozzles being spaced apart from one another;

an imaging sensor for forming an image of said dots in response to a control signal, said imaging sensor comprises a regular two-dimensional array of photodetectors, each row having more than one line of photodetectors; and a controller for processing said image and reading out information derived from said image, said controller comprising a plurality of analog-to-digital converters (A/D), each A/D corresponding to one of said rows, each A/D generating a digital value indicative of a selected photodetector in said row corresponding to said A/D, said selected photodetector being specified by a pointer, wherein said photodetectors are spaced apart from one another by a distance less than the minimum spacing between any two of said nozzles.

* * * * *